US008814599B2

(12) United States Patent
Wu

(10) Patent No.: US 8,814,599 B2
(45) Date of Patent: Aug. 26, 2014

(54) CABLE CONNECTOR ASSEMBLY WITH A CRIMPING RING

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 171 days.

(21) Appl. No.: 13/568,484

(22) Filed: Aug. 7, 2012

(65) Prior Publication Data

US 2013/0040492 A1 Feb. 14, 2013

(30) Foreign Application Priority Data

Aug. 10, 2011 (CN) ..... 2011 1 0228377

(51) Int. Cl.
*H01R 13/648* (2006.01)

(52) U.S. Cl.
USPC ..... 439/607.48; 439/607.55; 439/660

(58) Field of Classification Search
USPC ..... 439/607.48, 607.55, 607.41, 660
IPC ..... H01R 13/658,13/6581, 13/5808
See application file for complete search history.

(56) References Cited

U.S. PATENT DOCUMENTS

| | | | | |
|---|---|---|---|---|
| 7,690,948 | B2 * | 4/2010 | Lung | 439/607.27 |
| 8,142,226 | B2 * | 3/2012 | Xiao et al. | 439/607.56 |
| 8,500,494 | B2 * | 8/2013 | Wu | 439/660 |
| 8,668,523 | B2 * | 3/2014 | Wu | 439/607.23 |

FOREIGN PATENT DOCUMENTS

| | | | |
|---|---|---|---|
| CN | 1835300 | A | 9/2006 |

* cited by examiner

*Primary Examiner* — Hien Vu
(74) *Attorney, Agent, or Firm* — Ming Chieh Chang; Wei Te Chung

(57) ABSTRACT

A cable connector assembly comprises an insulative housing (1), a number of contacts (2), a cable (6) electrically connected with the contacts, and a metallic shell (3) enclosing the insulative housing. The insualtive housing includes a base portion (11) and a tongue portion (12) extending forwardly from the base portion. The metallic shell comprises a front shell (31) and a rear shell (32) combined with each other, the rear shell defines a pair of continued portions (322) extending backwards from an upper surface and a lower surface thereof, the continued portions is pressing on the cable, and the cable connector assembly further has a crimping ring (7) enclosing on the continued portions and the cable.

9 Claims, 8 Drawing Sheets

CABLE CONNECTOR ASSEMBLY WITH A CRIMPING RING

CROSS-REFERENCE TO RELATED APPLICATION

This application is related to a copending U.S. patent application Ser. No. 13/470552 filed on 2012, May 14 and entitled "CABLE CONNECTOR ASSEMBLY WITH AN IMPROVED SHELL," which has the same applicant and assignee as the present invention.

BACKGROUND OF THE INVENTION

1. Field of the Invention

The present invention generally relates to a cable connector assembly, and more particularly to a cable connector assembly for high speed signal transmission.

2. Description of Related Art

U.S. Pat. No. 8,142,226 issued to Xiao on Mar. 27, 2012 discloses a cable connector assembly in accordance with USB 3.0 standard, the cable connector assembly comprises an insulative housing, a plurality of contacts received in the insulative housing, a metallic shell enclosing the insulative housing, and a pair of latches retained in the insulative housing and exposed out of the metallic shell. Tail portions of the contacts are extending beyond a rear end of the insulative housing to be electrically connected with a cable.

The metallic shell of the cable connector assembly comprises two-pieces configuration along an up-to-down direction to crimp the cable and shield an electrical connection between the cable and the contacts. However, the cable connector assembly with two-pieces configuration tends to have a greater height and it is necessary to assemble the two pieces of members along the up-to-down direction to form a whole shielding member.

Hence, it is desirable to have an improved structure to overcome the above-mentioned disadvantages of the prior art.

BRIEF SUMMARY OF THE INVENTION

Accordingly, the object of the present invention is to provide a cable connector assembly with a crimping ring.

In order to achieve the above-mentioned object, a cable connector assembly in accordance with the present invention comprises an insulative housing, a number of contacts, a cable electrically connected with the contacts, and a metallic shell enclosing the insulative housing. The insulative housing includes a base portion and a tongue portion extending forwardly from the base portion. The metallic shell comprises a front shell and a rear shell combined with each other, the rear shell defines a pair of continued portions extending backwards from an upper surface and a lower surface thereof, the continued portions is pressing on the cable, and the cable connector assembly further has a crimping ring enclosing on the continued portions and the cable.

Other objects, advantages and novel features of the invention will become more apparent from the following detailed description of the present embodiment when taken in conjunction with the accompanying drawings.

DETAILED DESCRIPTION OF THE INVENTION

Figure 1:
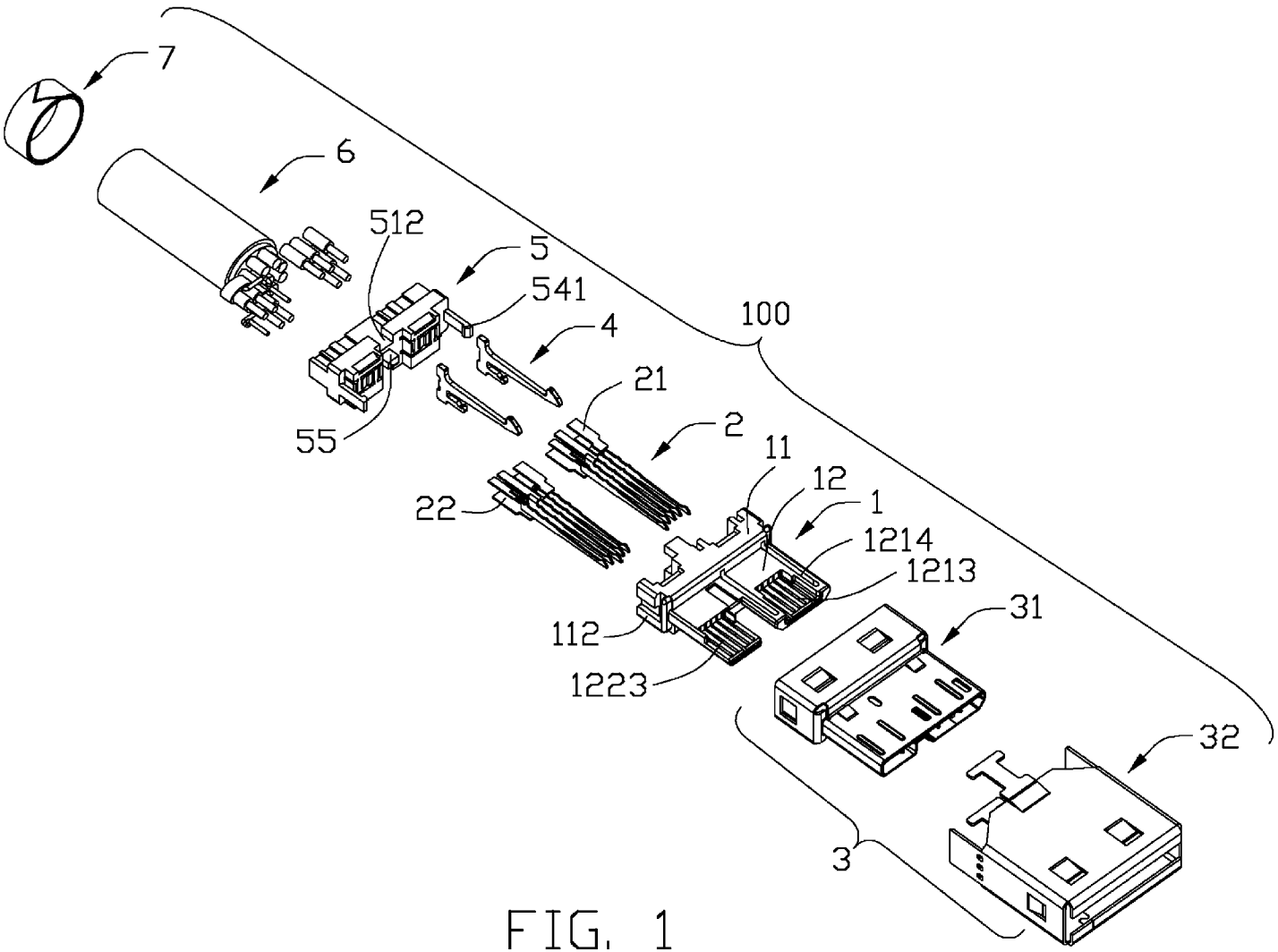
FIG. 1 is an exploded, perspective view of a cable connector assembly in accordance with the present invention.

Reference will now be made to the drawing figures to describe the present invention in detail.

Figure 2:
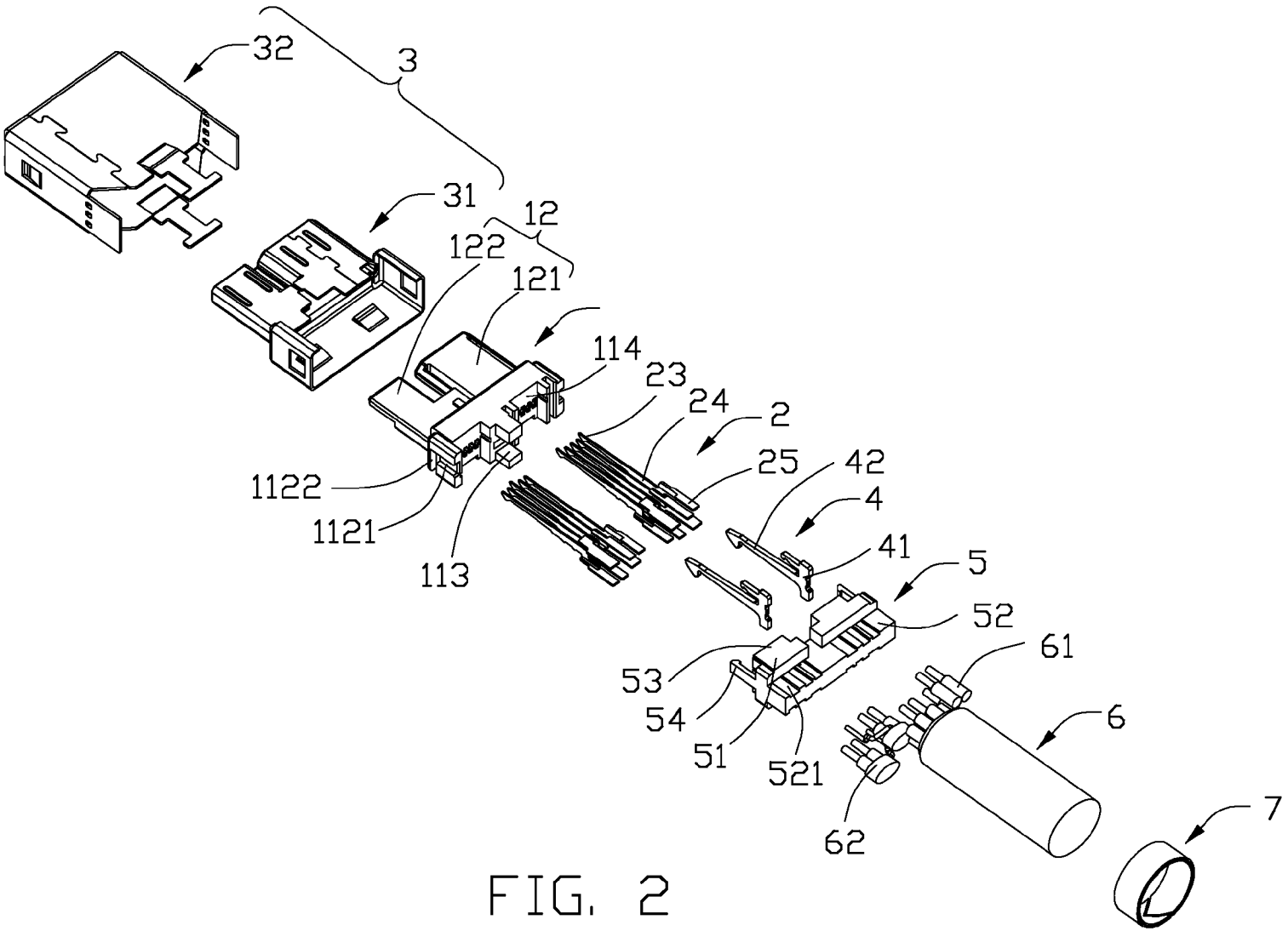
FIG. 2 is a view similar to FIG. 1, but viewed from a different angle.
Figure 3:
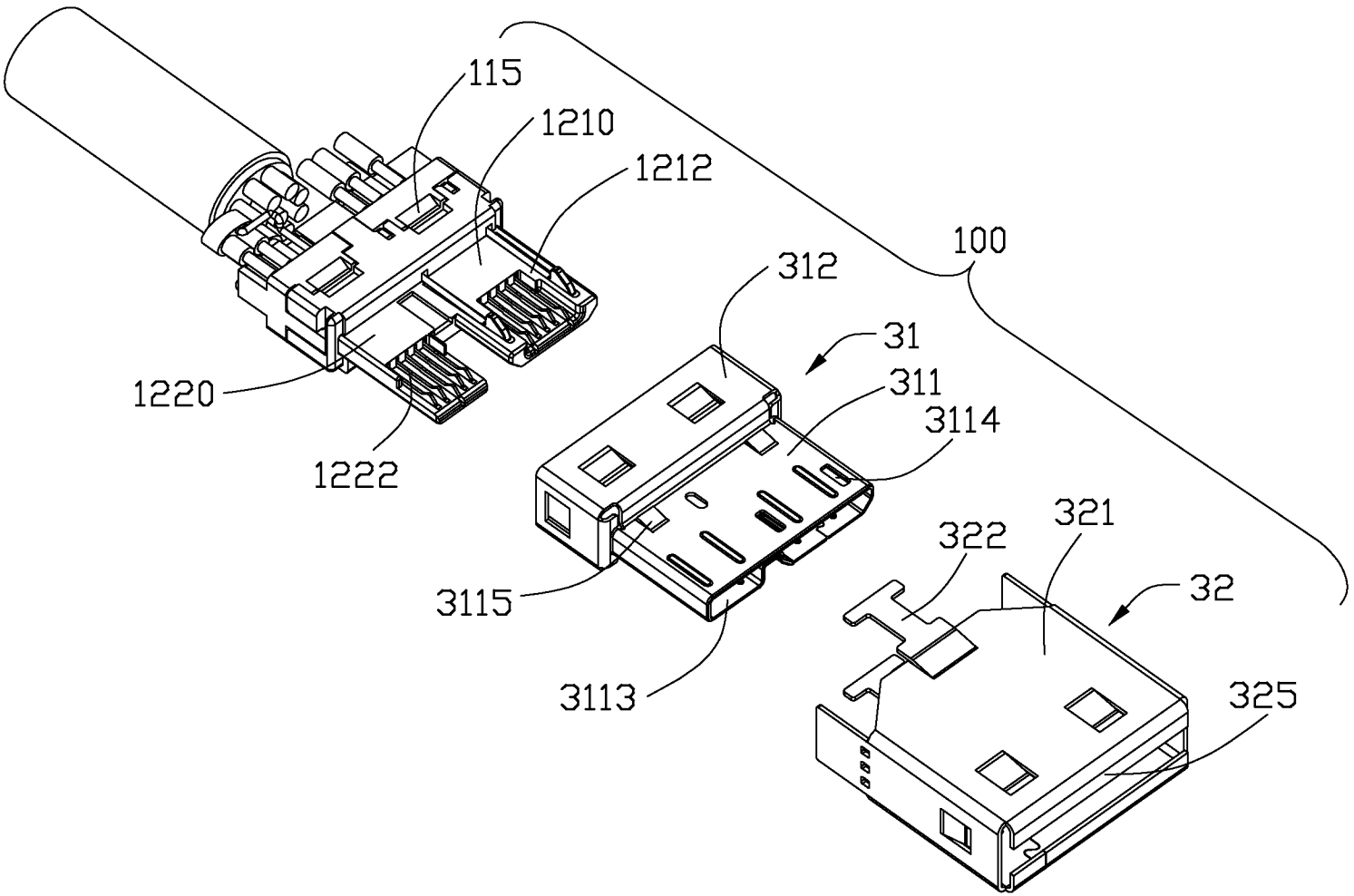
FIG. 3 is a partially assembled, perspective view of the cable connector assembly shown in FIG. 1.
Figure 4:
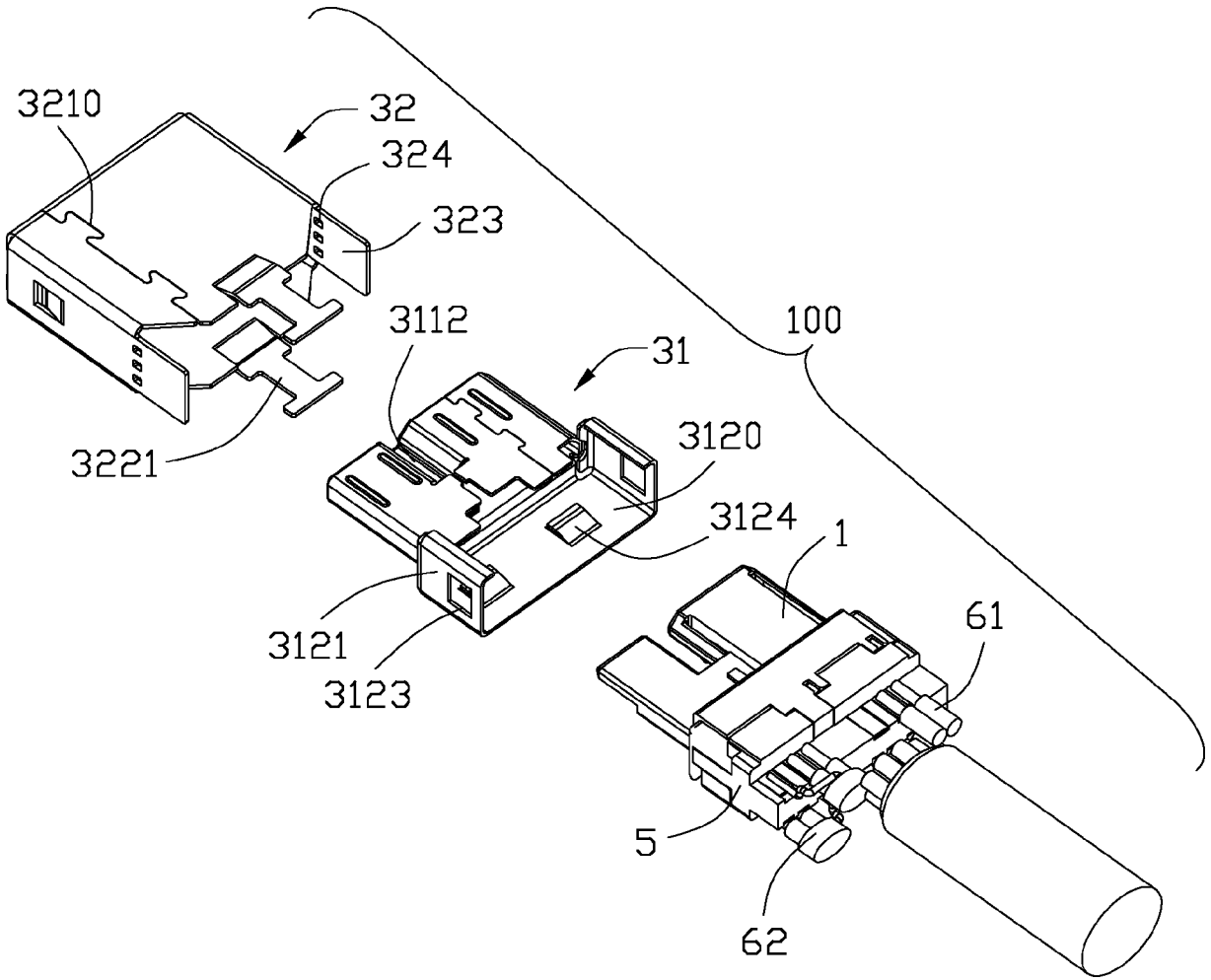
FIG. 4 is a view similar to FIG. 3, but viewed from a different aspect.
Figure 5:
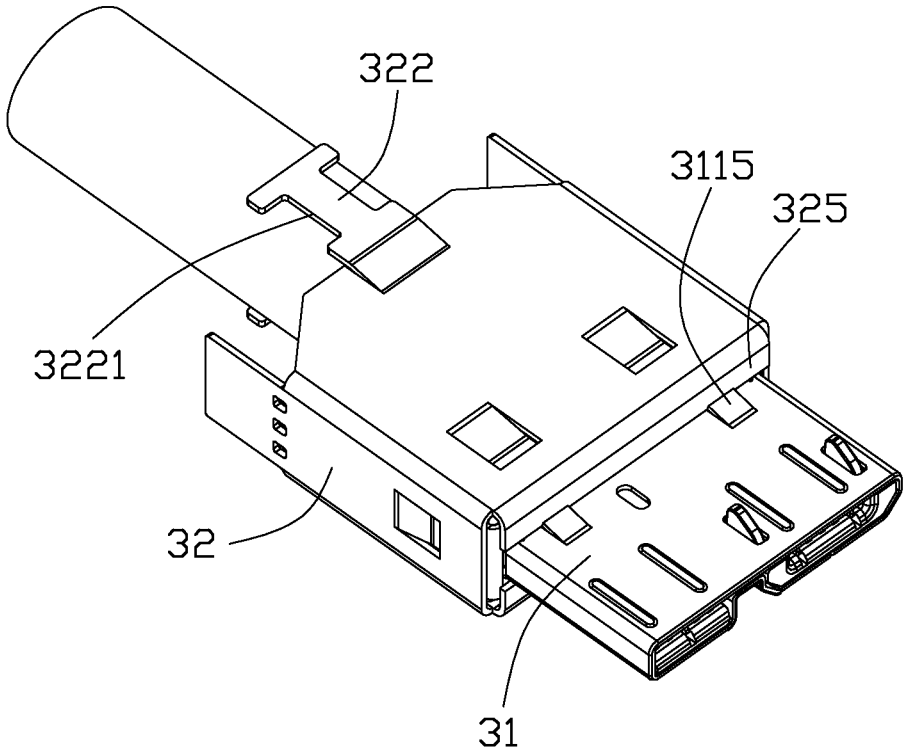
FIG. 5 is another partially assembled, perspective view of the cable connector assembly shown in FIG. 1.

Referring to FIGS. 1-5, a cable connector assembly 100 made in accordance with the present invention comprises an insulative housing 1, a plurality of contacts 2 held in the insulative housing 1, a metallic shell 3 enclosing the insulative housing 1, a pair of latches 4 retained in the insulative housing 1 and exposed out of the metallic shell 3, a spacer 5 fastened to the insulative housing 1 to support contacts 2, a cable 6 electrically connected with the contacts 2 and a crimping ring 7 enclosing on the cable 6.

Figure 6:
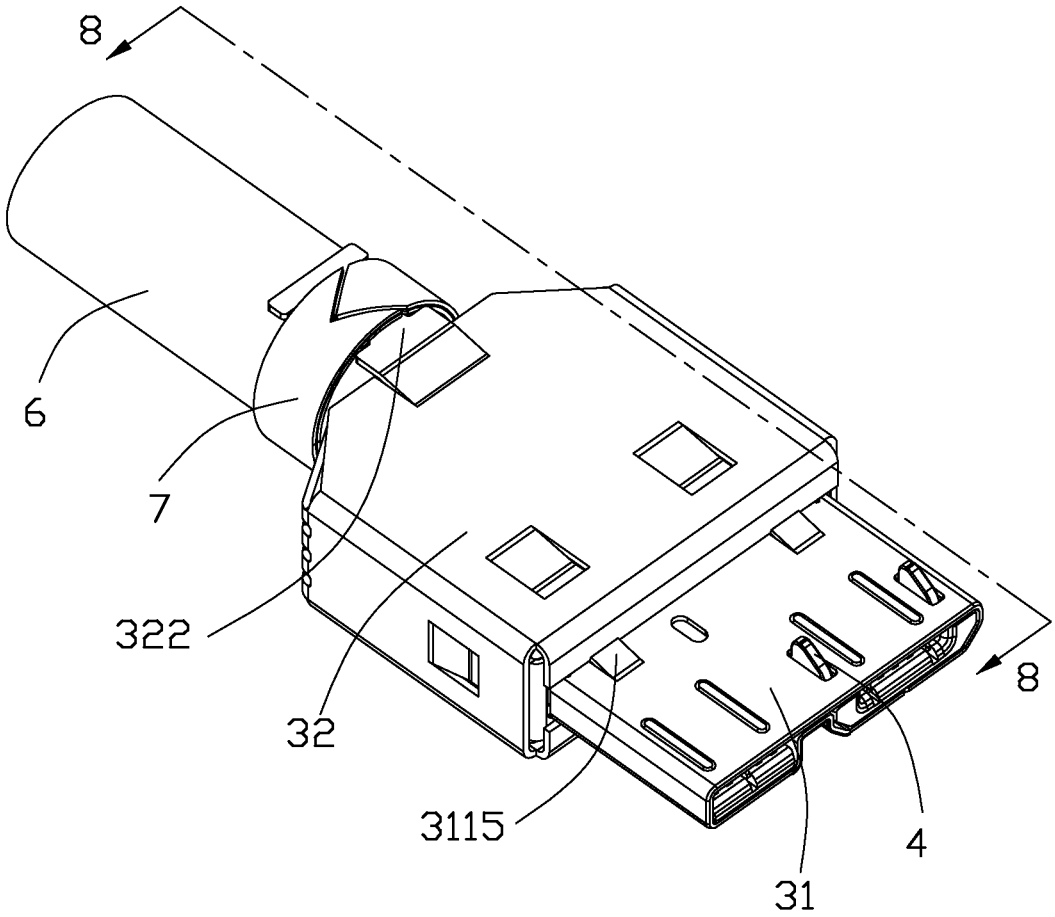
FIG. 6 is a further assembled, perspective view of the cable connector assembly shown in FIG. 5.
Figure 7:
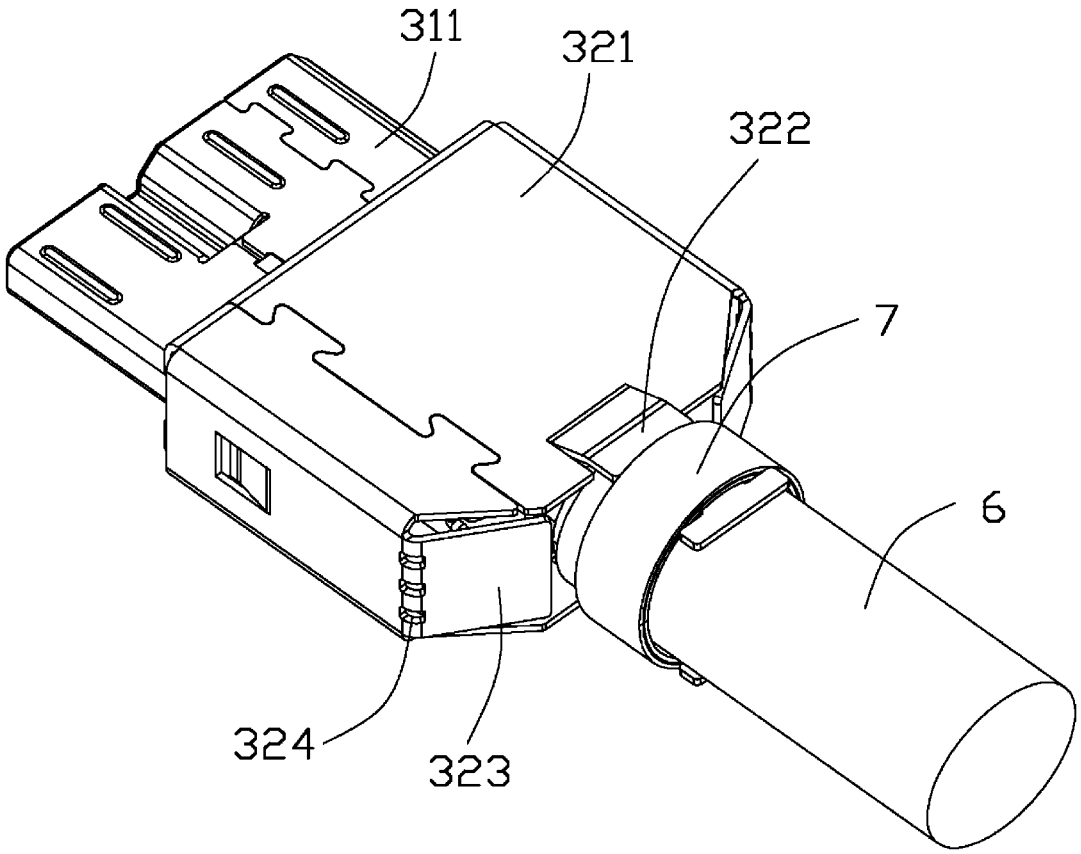
FIG. 7 is view similar to FIG. 6, but viewed from a different angle.
Figure 8:
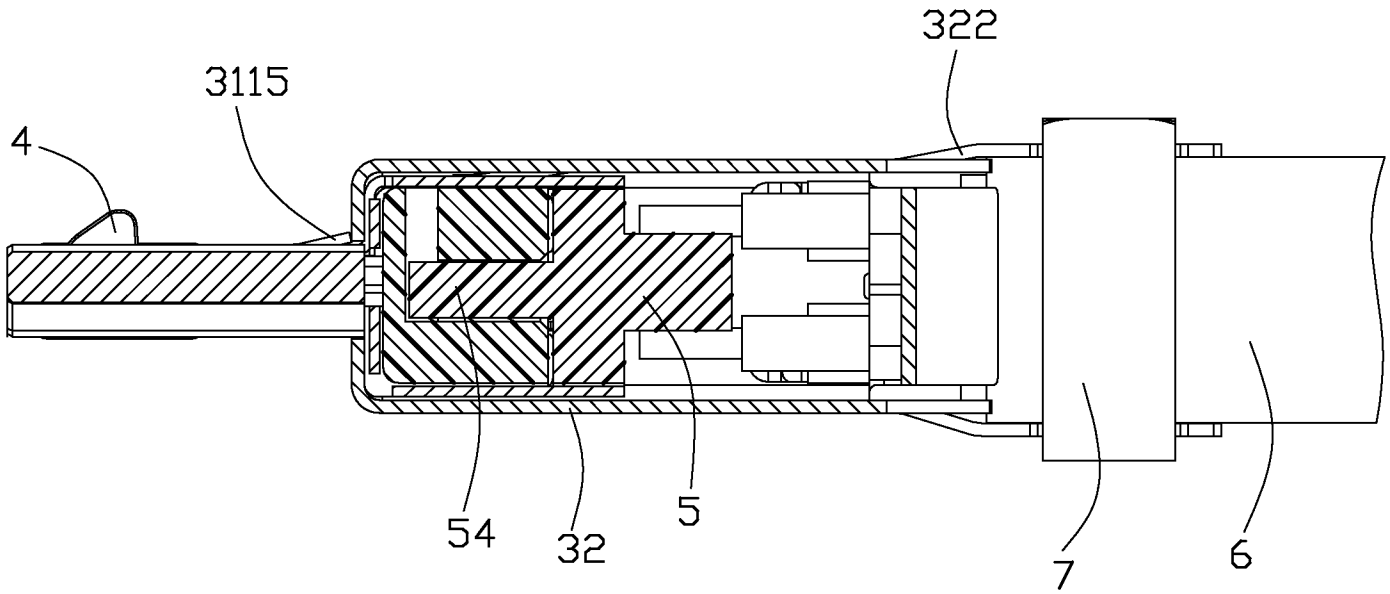
FIG. 8 is a cross-section view taken along line 8-8 of FIG. 6.

Referring to FIGS. 2-8, the insulative housing 1 includes a base portion 11 and a tongue portion 12 integrally extending forwardly beyond the base portion 11. The tongue portion 12 is split into a first tongue 121 and a second tongue 122 side by side arranged with each other and disposed in a common plane. The first tongue 121 is wider than the second tongue 122. The base portion 11 has a pair of lateral walls 112 opposite to each other, and each lateral wall 112 defines a first slot 1121 along a mating direction and a second slot 1122 perpendicular to the first slot 1121. The second slot 1122 is communicated with the first slot 1121 and deeper than the first slot 1121. The base portion 11 defines a pair of tabs 113 protruding rearwards from a back end thereof, and the two tabs 113 are arranged opposite to each other along a vertical direction perpendicular to the mating direction. The base portion 11 defines a pair of outlets 114 recessed forwardly from the back end thereof The first tongue 121 and the second tongue 122 are located on a same horizontal level, to make sure the cable connector assembly 100 with a low profile, and the size of the first tongue 121 is accordance with USB 2.0 standard. The first tongue 121 has a first rear segment 1210 mechanically connected with the base portion 11 and a first front segment 1212 away from the base portion 11. Relative to the first tongue 121, the second tongue 122 defines a second rear segment 1220 and a second front segment 1222. The first rear segment 1210 and the second rear segment 1220 are of a unitary configuration to make the tongue portion 12 stable, and the first front segment 1212 and the second front segment 1222 are spaced apart from each other to form two independent mating ports.

The first tongue 121 defines a plurality of first passages 1213 parallel to each other, the first passages 1213 are extending along the mating direction, and extending through the base portion 11. A pair of channels 1214 are defined on lateral sides of the first passages 1213 to receive the latches 4, and the channels 1214 are extending through the base portion 11.

Similar to the first tongue 121, the second tongue 122 defines a number of second passages 1223 parallel to the first passages 1213, and the second passages 1223 are extending through the base portion 11.

The contacts 2 include a plurality of first contacts 21 and a plurality of second contacts 22, and the first contacts 21 are received in the corresponding first passages 1213 with the second contacts 22 received in the corresponding second passages 1223. The first contacts 21 are compatible to version 2.0 Micro Universal Serial Bus. Each contact 2 comprises a contacting portion 23 extending along the mating direction, a retaining portion 24 extending rearwards from the contacting portion 23, and a tail portion 25 bent downwards or upwards from the retaining portion 24. The tail portion 25 is located in a horizontal plane.

The second contacts 22 include five conductive contacts, and the middle one of the second contacts 22 is a grounding contact, a pair of signal contact for transmitting high speed signal and a pair of signal contacts for receiving high speed signal are located on both sides of the grounding contact. The grounding contact has a pair of soldering portions on an upper side and a lower side of a rear section.

The first contacts 21 also include five conductive contacts, and the middle one of the first contacts 21 is a signal contact, the signal contact of the first contacts 21 and the grounding contact of the second contacts 22 have the same configuration with each other, so the first contacts 21 have six soldering portions arranged on two levels for preventing cross-talk.

The metallic shell 3 includes a front shell 31 and a rear shell 32. The front shell 31 comprises a front sleeve portion 311 in the front thereof and a rear engaging portion 312 extending rearwards from the sleeve portion 311. The sleeve portion 311 defines a depression 3112 relative to a gap between the first front segment 1212 and the second front segment 1222, and the depression 3112 is divided the sleeve portion 311 into two mating cavities 3113 for receiving the first tongue 121 and the second tongue 122. The sleeve portion 311 defines a pair of notches 3114 receiving the latches 4. The sleeve portion 311 defines a pair of stopping portions 3115 on a back end thereof and neighboring to the engaging portion 312.

The engaging portion 312 is of U-shape, and comprises a bottom wall 3120 and a pair of side walls 3121 connected with the bottom wall 3120, each side wall 3121 defines a locking hole 3123. A pair of elastic portions 3124 are defined on the bottom wall 3120.

The rear shell 32 comprises a main body 321 with a cross-section view of rectangular frame shape, the main body 321 has a joining line 3210 on an upper wall thereof The rear shell 32 defines a pair of continued portions 322 extending backwards from an upper surface and a lower surface thereof A pair of cutouts 3221 are formed on both sides of each continued portion 322, and the cutouts 3221 are opposite to each other, thus each continued portion 322 is of T-shape. The main body 321 defines a pair of shielding portions 323 extending rearwards from lateral sides thereof, the shielding portions 323 are opposite to each other. A plurality of through holes 324 are disposed on a conjunction area of each shielding portion 323 and the main body 321, and the through holes 324 on a same side are arranged along a vertical direction.

Each latch 4 comprises a retaining standoff 41 held in the base portion 11 of the insulative housing 1 and an engaging arm 42 extending forwards from the retaining standoff 41, the engaging arm 42 is received in the relative channel 1214 of the insulative housing 1.

The spacer 5 is made of insulative material, and comprises a primary portion 51, an extension portion 52 extending backwards from a rear end of the primary portion 51, a pair of rectangular protrusions 53 extending forwards from a front end of the primary portion 51 and a pair of elongate arms 54 extending forwards from lateral sides of the primary portion 51. The primary portion 51 defines a pair of openings 512 on a top and a bottom surface thereof, the openings 512 are defined neighboring to a middle area of the primary portion 51, and divides the primary portion 51 into two segments along the transverse direction. A plurality of grooves 521 are defined on a top surface and a bottom surface of the extension portion 52, for receiving the tail portions 25 of the contacts 2, and there are six grooves 521 defined on the top surface and the bottom surface respectively, and the six grooves 521 on the same surface are equally divided into two groups by the opening 512. The protrusions 53 have a top plane coplanar to an upper surface of the primary portion 51, and a bottom plane of the protrusions 53 is coplanar to a lower surface of the primary portion 51. Each protrusion 53 comprises a plurality of gateways (not shown) recessed from a front end thereof along a front-to-back direction, and the gateways are defined in a vertical direction. Each elongate arm 54 defines a tuber 541 on a front end thereof for assorting with the corresponding lateral wall 112 of the insulative housing 1. A block 55 is disposed on a front end of the spacer 5, and located between the pair of protrusions 53, the block 55 has a small size.

The cable 6 is divided into two groups, and the first group comprises five individual wires 61 connected with the first contacts 21, and the second group comprises two STP (Shielded Twisted Pair) wires 62 for high speed signal transmission.

The crimping ring 7 is a slim plate before assembling, and two free ends thereof can be bent towards each other to form a circular configuration, for enclosing a rear part of the metallic shell 3 and the cable 6.

In assembly, the contacts 2 are inserted into the insulative housing 1 along a back-to-front direction, the first contacts 21 and the second contacts 22 are accommodated in the first passages 1213 of the first tongue 121 and the second passages 1223 of the second tongue 122 respectively, the latches 4 are inserted into the channels 1214 of the first tongue 121. The tail portions 25 of the contacts 2 are exposed beyond the insulative housing 1. Then the spacer 5 is assembled to a back end of the insulative housing 1 along the back-to-front direction, the elongate arms 54 on both sides of the spacer 5 are sliding in the first slots 1121 of the insulative housing 1, until the tubers 541 of the elongate arms 54 locked in the second slots 1122. The protrusions 53 of the spacer 5 are accommodated in the corresponding outlets 114 of the insulative housing 1, to prevent the spacer 5 moving relative to the insulative housing along the transverse direction. The block 55 of the spacer 5 is interferentially cooperated with an indentation (not labeled) on the back end of the insulative housing 1. The pair of tabs 113 of the insulative housing 1 are inserted into the corresponding openings 512 of the spacer 5. A pair of matching holes 115 are formed on a conjunction area between a front end of the bottom plane of the spacer 5 and the back end of the housing 1.

The contacts 2 are inserted into the gateways of the spacer 5 respectively, and the tail portions 25 are exposed in the grooves 521 of the extension portion 52. The wires 61 of the cable 6 are soldered to corresponding tail portions 25 of the first contacts 21, the STP wires 62 are electrically connected with the second contacts 22.

Then the insulative housing 1 is assembled into the front shell 31, the tongue portion 12 of the insulative housing 1 is received in the sleeve portion 311 of the front shell 31, and the first tongue 121 and the second tongue 122 are received in the mating cavities 3113 respectively. The two mating cavities 3113 can prevent the first and second front segment 1212, 1222 swaying. The engaging arms 42 of the latches 4 are received in the notches 3114 and exposed out of the front shell 31. The elastic portions 3124 on the front shell 31 are locked in the corresponding matching holes 115 formed by the spacer 5 and the insulative housing 1.

Then the aforementioned components are assembled into the rear shell 32, the main body 321 of the rear shell 32 is enclosing the engaging portion 312 of the front shell 31, the stopping portions 3115 of the front shell 31 are abutting against to a front flange 325 of the rear shell 32. The shielding portions 323 on both sides of the rear shell 32 are bent towards each other to shield a back end of the rear shell 32, the shielding portions 323 can be bent conveniently as the through holes 324 on conjunction areas of each shielding portion 323 and the main body 321. The continued portions 322 of the rear shell 32 are pressing on an insulated jacket of the cable 6, the crimping ring 7 is enclosing the continued portions 322 and locked in the cutouts 3221 of the continued portions 322.

The front shell 31 is assembled to the rear shell 32 to enclose the insulative housing 1 and an electrical connection between the contacts 2 and the cable 6. Thus, the cable connector assembly 100 is assembled.

The cable connector assembly is compatible to standard USB 2.0 connector. The size of the first tongue 121 and the arrangement of the first contacts 21 are in accordance with USB 2.0 plug connector standard.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing including a base portion and a tongue portion extending forwardly from the base portion;

a plurality of contacts received in the insulative housing and held in the tongue portion;

a cable electrically connected with the contacts; and a metallic shell enclosing the insulative housing;

wherein the metallic shell comprises a front shell and a rear shell combined with each other, the rear shell defining a pair of continued portions extending backwards from an upper surface and a lower surface thereof, the continued portions pressing on the cable, and the cable connector assembly further having a crimping ring enclosing on the continued portions and the cable;

wherein the rear shell comprises a main body of rectangular frame shape;

wherein the front shell comprises a front sleeve portion and an engaging portion extending rearwards from the sleeve portion, and the main body of the rear shell encloses the engaging portion of the front shell;

wherein the main body of the rear shell defines a pair of shielding portions extending rearwards from lateral sides thereof, and the shielding portions are bent towards each other to shield a back end of the rear shell;

wherein a plurality of through holes are disposed on a conjunction area of each shielding portion and the main body, and the through holes on a same side are arranged along a vertical direction;

wherein a spacer assembled to the insulative housing and supporting the contacts, and wherein the spacer defines a pair of openings on a top and a bottom surface thereof, the insulative housing defines a pair of tabs protruding rearwards from a back end thereof, and the tabs are inserted into the corresponding openings of the spacer.

2. The cable connector assembly as claimed in claim 1, wherein the engaging portion is of U-shape and comprises a bottom wall and a pair of side walls connected with the bottom wall.

3. The cable connector assembly as claimed in claim 2, further comprising a spacer defining together with the insulative housing a pair of matching holes, and wherein the bottom wall comprises a pair of elastic portions locked in corresponding matching holes.

4. The cable connector assembly as claimed in claim 1, wherein the sleeve portion of the front shell defines a pair of stopping portions on a back end thereof, and the stopping portions abuts against a front flange of the main body.

5. The cable connector assembly as claimed in claim 1, wherein each continued portion defines a pair of cutouts on both sides thereof.

6. The cable connector assembly as claimed in claim 5, wherein the cutouts are opposite to each other, and each continued portion is of T-shape.

7. The cable connector assembly as claimed in claim 5, wherein the crimping ring is locked in the cutouts of the continued portions.

8. A cable connector assembly comprising:

an insulative housing defining a rear base portion and a front mating tongue extending forwardly from the base portion in a front-to-back direction;

a plurality of contacts disposed in the housing with front contacting sections exposed upon the front mating tongue, and rear tail sections;

a round cable including a plurality of wires respectively electrically connected to the rear tail sections of the corresponding contacts;

a metallic shell device enclosing said housing and including a front shell and a rear shell assembled to each other, the front shell defining a front sleeve portion enclosing the front mating tongue, and a rear engaging portion enclosing the rear base portion, the rear shell defining a tubular main body receiving the rear engaging portion and the rear tail sections, at least one continued portion extending rearwardly from the main body; and a crimping ring being discrete from the continued portion while circumferentially crimping the round cable with said continued portion therebewteen;

wherein the main body of the rear shell defines a pair of shielding portions extending rearwards from lateral sides thereof, and the shielding portions are bent towards each other to shield a back end of the rear shell;

wherein said rear shell further includes another continued portion extending rearwardly from the main body opposite to said continued portion in a vertical direction perpendicular to said front-to-back direction;

wherein the main body defines an upper front edge and a lower front edge along a transverse direction perpendicular to both said front-to-back direction and said vertical direction, and a pair of flanges extend from said upper front edge and said lower front edge, respectively, toward each other in the vertical direction, to form said narrowed front opening; and wherein said continued potion defines a neck to receive the crimping ring therein for preventing relative movement therebetween in the front-to-back direction.

9. The cable connector assembly as claimed in claim 8, wherein the main body defines a narrowed front opening through which the sleeve portion extends forwardly.

* * * * *